US006812440B2

(12) United States Patent
Hirota et al.

(10) Patent No.: US 6,812,440 B2
(45) Date of Patent: Nov. 2, 2004

(54) INDUCTION HEATING DEVICE

(75) Inventors: Izuo Hirota, Osaka (JP); Atsushi Fujita, Osaka (JP); Takahiro Miyauchi, Hyogo (JP); Yuji Fujii, Hyogo (JP); Akira Kataoka, Hyogo (JP); Koji Niiyama, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/483,791

(22) PCT Filed: Nov. 21, 2001

(86) PCT No.: PCT/JP01/10171

§ 371 (c)(1),
(2), (4) Date: May 17, 2004

(87) PCT Pub. No.: WO03/045114

PCT Pub. Date: May 30, 2003

(65) Prior Publication Data

US 2004/0188426 A1 Sep. 30, 2004

(51) Int. Cl.[7] ..... H05B 6/06; H05B 6/12

(52) U.S. Cl. ..... 219/626; 219/664; 219/665; 219/663; 219/518; 99/325; 363/95

(58) Field of Search ..... 219/620–627, 219/661–668, 518; 99/325, DIG. 14; 363/74, 95

(56) References Cited

U.S. PATENT DOCUMENTS 4,447,691 A * 5/1984 Mizukawa et al. ..... 219/626
4,456,807 A * 6/1984 Ogino et al. ..... 219/626
4,467,165 A * 8/1984 Kiuchi et al. ..... 219/664

FOREIGN PATENT DOCUMENTS

| | | |
|---|---|---|
| JP | 61-71582 | 4/1986 |
| JP | 61-128492 | 6/1986 |
| JP | 61-230289 | 10/1986 |
| JP | 62-276787 | 12/1987 |
| JP | 10-241850 A | 9/1998 |
| JP | 2001-332375 A | 11/2001 |

OTHER PUBLICATIONS

International Search Report for PCT Application PCT/JP01/10171, mailed Jan. 15, 2002 with English translation of PCT/ISA/210.

* cited by examiner

*Primary Examiner*—Philip H. Leung
(74) *Attorney, Agent, or Firm*—RatnerPrestia

(57) ABSTRACT

An induction heating device prevents an object to be heated from being displaced and buoyed from a mounting surface due to an mutual action of repulsive forces between the object to be heated and an induction heating coil. The induction heating device includes a source-current detector for detecting a source current input to a high-frequency inverter including the induction heating coil and an inverter circuit, a source-current change detector for measuring a change against time of a magnitude of the source current to detect a displacement and buoying of the object to be heated, such as a cooking pot, and a change examining unit. The controller controls an output of the high-frequency inverter in response to a detection result of the change examining unit. The induction heating device prevents the cooking pot from being displaced and buoyed even if the pot is not touched by a user at startup of heating or during the heating operation, and is inexpensive and safe.

6 Claims, 11 Drawing Sheets

INDUCTION HEATING DEVICE

THIS APPLICATION IS A U.S. NATIONAL PHASE APPLICATION OF PCT INTERNATIONAL APPLICATION PCT/JP01/10171.

TECHNICAL FIELD

The present invention relates to an induction heating device, such as an induction heating range or a water boiler and a humidifier utilizing induction heating, for use in home, offices, restaurants, or factories.

BACKGROUND ART

An induction heating range will be explained as an induction heating device. The induction heating range includes an induction heating coil for generating a high-frequency magnetic field producing eddy currents in an object to be heated, such as a metallic cooking pot 3, placed near the induction heating coil.

A conventional induction heating range will be explained in more detail referring to FIG. 10. As shown in FIG. 10, the range includes a high-frequency inverter 1 having two switching elements (not shown) and an induction heating coil 2 electrically connected to the high-frequency inverter 1.

A high frequency current is supplied from the high-frequency inverter 1 causes the induction heating coil 2 to generate a high-frequency magnetic field producing eddy currents for heating the cooking pot 3. For adjusting and stabilizing the high frequency current, the high-frequency inverter 1 is monitored in a source current supplied to the inverter with a current transformer (not shown). According to a result of the monitoring, the high-frequency current a driving frequency of the switching elements (not shown) is changed, or a duty for driving the elements while the driving frequency is constant. These operations control the output of the high-frequency inverter 1. In addition, the current flowing in the induction heating coil 2 is monitored with the current transformer (not shown), and the output of the high-frequency inverter 1 is controlled according to a result of the monitoring. For example, the output may be suppressed for reducing a load to the switching elements if the cooking pot 3 is made of non-magnetic stainless steel.

When the cooking pot 3 to be heated is made of non-magnetic metal, such as aluminum or copper, the conventional induction heating range allows the cooking pot 3 to be affected by a counter force of a magnetic field. Containing material having a decreasing overall weight, or receiving an increasing heat, the cooking pot 3 may displace laterally, and may be buoyed from a top plate 4. FIG. 11 illustrates a profile of the relationship between an input power and a buoyant force when the cooking pot 3 of the non-magnetic metal is heated. In FIG. 11, the horizontal axis represents a the power input to the high-frequency inverter 1 while the vertical axis represents the buoyant force exerted on the cooking pot. As shown in FIG. 11, the more the input power, the more the buoyant force increases. In other words, when the buoyant force exceeds the weight, the cooking pot is displaced or buoyed.

For eliminating the foregoing drawbacks, some techniques are disclosed in Japanese Patent Laid-Open Publications No.61-128492 and No.62-276787, in which weight sensors are used for detecting displacement of cooking pots. Japanese Patent Laid-Open Publications No.61-71582 and No.61-230289 disclose a magnetic sensor and a resonant frequency measuring unit, respectively, for detecting the displacement. However, the conventional techniques disclosed in the above publications necessarily include the sensors for detecting the displacement of cooking pots, such as the weight sensor, the magnetic sensor, and the frequency measuring unit, thus increasing the overall cost of production or the number of components.

SUMMARY OF THE INVENTION

An induction heating device prevents an object to be heated from being displaced or buoyed due to a magnetic field generated by an induction heating coil. The displacement and buoyancy is prevented by either a source current detector for controlling a high-frequency inverter and an output detector for examining data about a magnitude of an output, such as heating coil current or voltage, of the high-frequency inverter. The induction heating device hence has a simple structure and is inexpensive even if including some extra components. The heating device has a small number of components and can thus has an improved operational reliability.

The induction heating device includes an induction heating coil for generating a high frequency magnetic field to heat an object to be heated, an inverter for supplying a high frequency current to the induction heating coil, an output detector for detecting a magnitude of an output of the inverter, a displacement detector for detecting a displacement of the object based on a change against time of the magnitude of the output of the inverter detected by the output detector, and a controller for controlling the output of the high-frequency inverter according to a result of detection of the displacement detector.

DESCRIPTION OF THE PREFERRED EMBODIMENTS

Exemplary Embodiment 1

Figure 1:
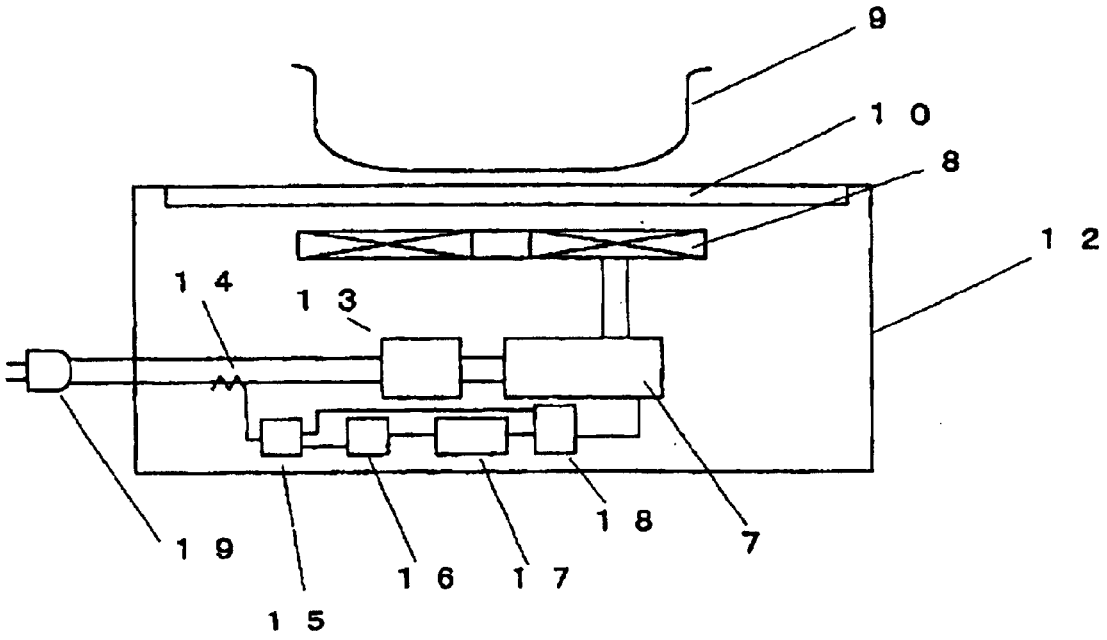
FIG. 1 is a schematic view of an induction heating device according to Exemplary Embodiment 1 of the present invention.
Figure 2:
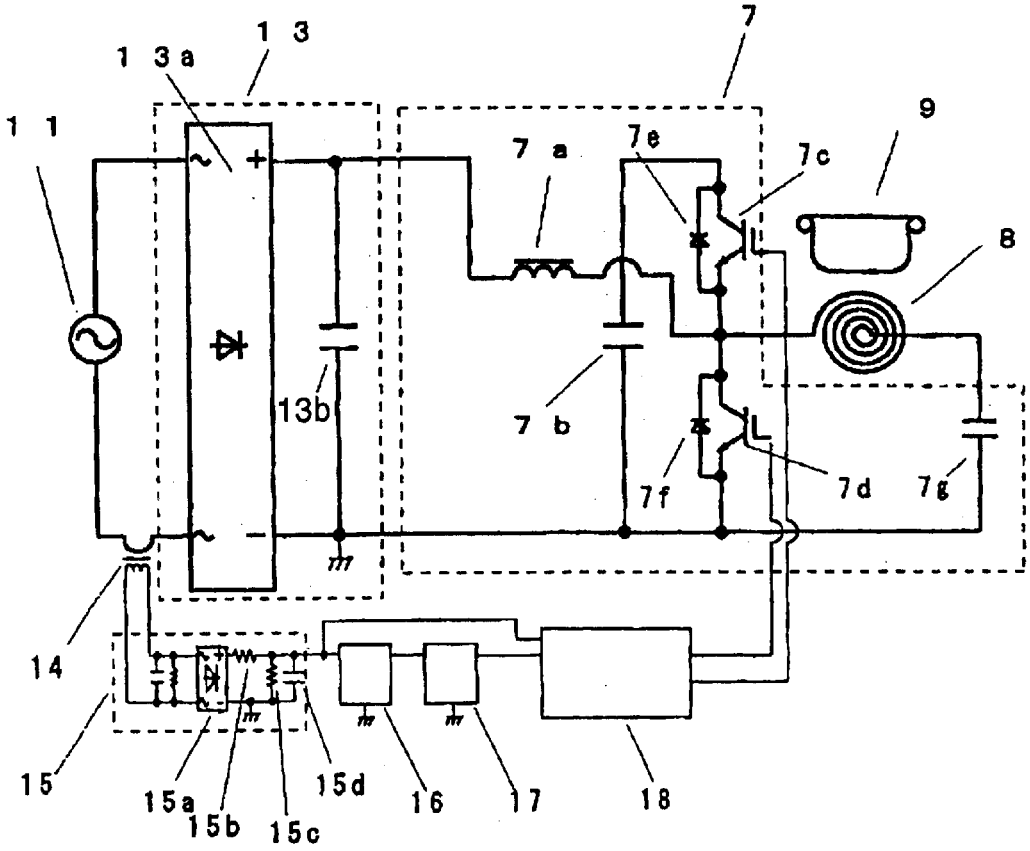
FIG. 2 is a circuitry block diagram of the induction heating device of Embodiment 1.

FIG. 1 is a schematic cross sectional view of an induction heating range according to Exemplary Embodiment 1 of the present invention. FIG. 2 is a block diagram of the induction heating range. As shown in FIGS. 1 and 2, a top plate 10 made of ceramic material is provided on the top of a case 12. and a cooking pot 9 to be heated is placed on the top plate 10. A power source plug 19 is connected to a commercial power source 11. The commercial power source 11 is input to a rectifying/smoothing section 13 in the case 12. The rectifying/smoothing section 13 includes a full-wave rectifier 13*a* having a bridge diode construction and a first smoothing capacitor 13*b* connected between DC outputs of the full-wave rectifier 13*a*.

The first smoothing capacitor 13*b* has both ends connected to an inverter circuit 7 connected to an induction heating coil 8. The inverter circuit 7 and the induction heating coil 8 provides a high-frequency inverter. The inverter circuit 7 includes an assembly having a first switching element 7*c* (implemented by an IGBT in this embodiment) and a second switching element 7*d* (implemented by an IGBT in this embodiment) connected in series to the element 7*c*. The first switching element 7*c* is connected in inverse parallel to a first diode 7*e* while the second switching element 7*d* is connected in inverse parallel to a second diode 7*f*. The assembly of the IGBTs 7*c* and 7*d* has both ends connected to a second smoothing capacitor 7*b*. A choke coil 7*a* is connected between a node of the assembly and a positive terminal of the full-wave rectifier 13*a*. The lower potential ends of the assembly is connected to a negative terminal of the full-wave rectifier 13*a*. The induction heating coil 8 is connected in series to a resonant capacitor 7*g* to form another assembly which is connected between the node of the switching elements of the assembly and the negative terminal of the full-wave rectifier 13*a*.

A current transformer 14 detects a source current supplied from the commercial power source 11 to the inverter circuit 7 and provides a source-current detector 15 with a detection signal. The source-current detector 15 produces and outputs a detection signal proportional to the magnitude of the source current to a controller 18 and a source-current-change detector 16.

The source-current-change detector 16 produces and outputs a detection signal to a change examining unit 17 supplying an examination signal to the controller 18. The source-current-change detector 16 and the change examining unit 17 provides a displacement detecting section. The controller 18 drives the first switching element 7*c* and the second switching element 7*d* in the inverter circuit 7.

An operation of the induction heating range having the foregoing arrangement will be explained. The commercial power source 11 is rectified by the full-wave rectifier 13*a*, and the first smoothing capacitor 13*b* energizes the high-frequency inverter including the inverter circuit 7 and the induction heating coil 8.

Figure 3:
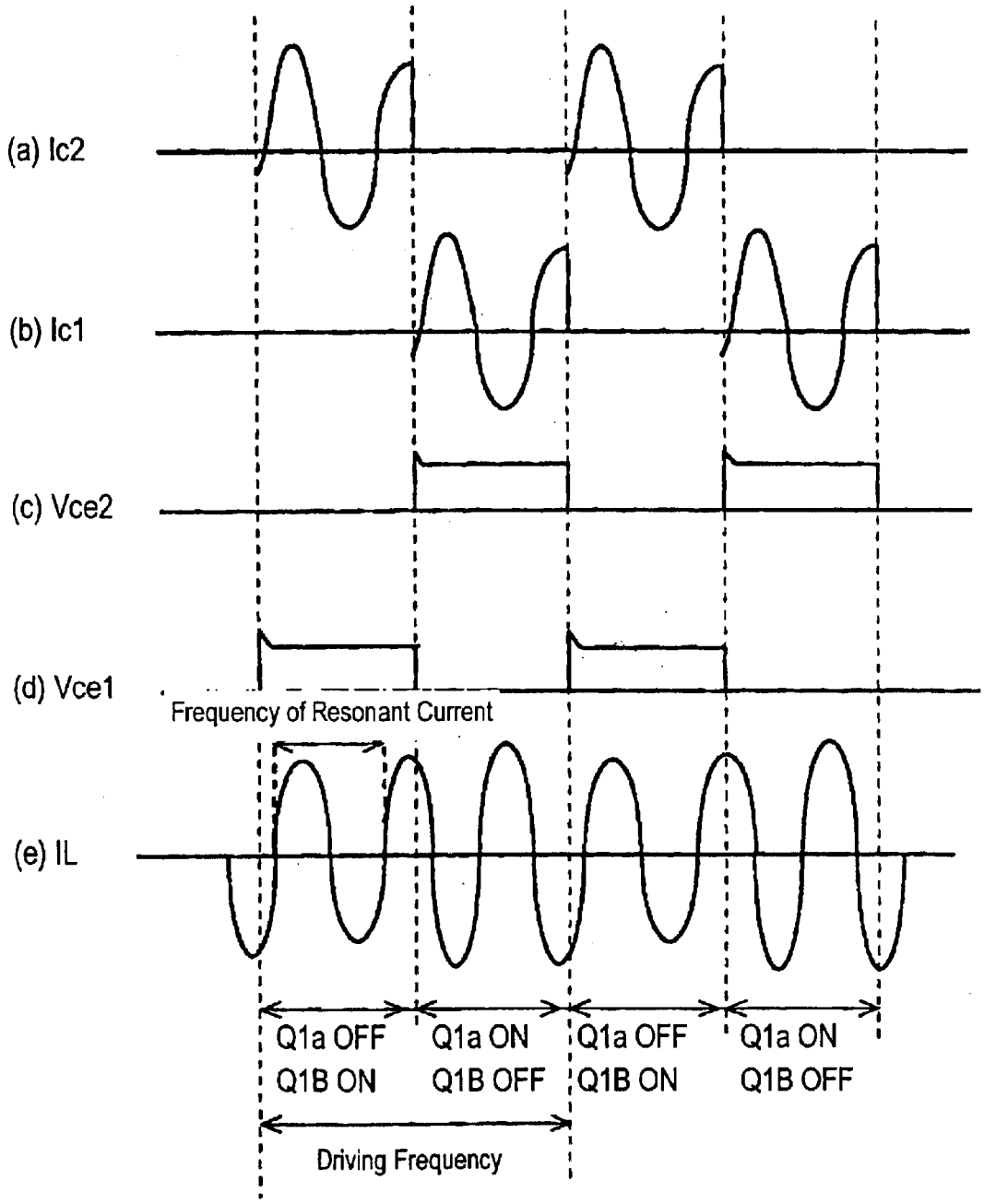
FIG. 3 illustrates waveforms at portions in the induction heating device of Embodiment 1.

FIG. 3 illustrates waveforms of signals in the range of Embodiment 1. A waveform (a) represents a current Ic2 flowing in the second switching element 7*d* and the second diode 7*f*. A waveform (b) represents a current Ic1 flowing in the first switching element 7*c* and the first diode 7*e*. A waveform (c) represents a voltage Vce2 between a collector and an emitter of the second switching element 7*d*. A waveform (d) represents a voltage Vce1 between a collector and an emitter of the first switching element 7*c*. A waveform (e) represents a current IL flowing in the induction heating coil 8.

When the second switching element 7*d* is turned on, a closed circuit including the induction heating coil 8, the resonant capacitor 7*g*, and the second switching element 7*d* (or the second diode 7*f*) generates a resonant current flowing in the closed circuit, and simultaneously the choke coil 7*a* stores an energy. Upon the second switching element 7*d* being turned off, the stored energy is discharged via the first diode 7*e* to the second smoothing capacitor 7*b*.

After the second switching element 7*d* is turned off, the first switching element 7*c* is turned on, and a current flows in the first diode 7*e*. Then, a resonant current flows in a closed circuit including the first switching element 7*c* (or the first diode 7*e*), the induction heating coil 8, the resonant capacitor 7*g*, and the second smoothing capacitor 7*b*.

A driving frequency for the first switching element 7*c* and the second switching element 7*d* is adjusted around 25 kHz, and a driving duty of the driving is adjusted around ½, as shown in FIG. 3. Respective impedances of the induction heating coil 8 and the resonant capacitor 7*g* are determined so that a resonant frequency determined when the cooking pot 9 made of given material (e.g. conductive and non-magnetic material, such as aluminum) is placed on a location (e.g. a heating area) of the top plate 10 is about three times greater than the driving frequency. The resonant frequency is thus determined to be substantially 75 kHz.

The induction heating coil 8 generates a high frequency current of about 75 kHz and heats the cooking pot 9 made of aluminum effectively. The high-frequency inverter of Embodiment 1 provides an efficient heating since regenerative currents flowing in the first diode 7*e* and the second diode 7*f* is supplied to the second smoothing capacitor 7*b* but not to the first smoothing capacitor 13*b*. Since the second smoothing capacitor 7*b* smoothes the envelop of the high-frequency current to be supplied to the induction heating coil 8 more than that of a conventional cooking device, an undesired component at a commercial frequency in vibrations of the cooking pot during the heating is reduced.

Moreover, the high-frequency inverter of the embodiment has an advantage of decreasing the input power when the magnetic coupling between the induction heating coil 8 and the cooking pot 9 declines under the same driving conditions (such as the driving frequency and the driving duty).

Receiving the signal, which is proportional to the source current, output from the source-current detector 15, the controller 18 controls the input power (an output of the high-frequency inverter) to be a predetermined level by adjusting the driving frequency or the driving duty for driving the first switching element 7*c* and the second switching element 7*d*.

Figure 4A:
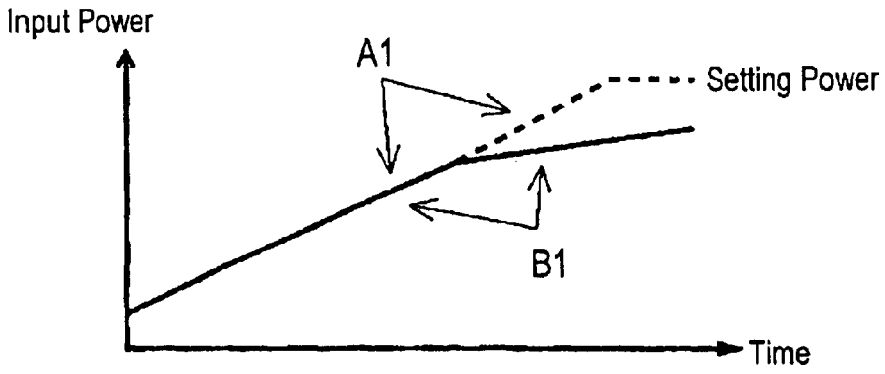
FIG. 4A illustrates a change against time of a power input to the induction heating device of Embodiment 1.
Figure 4B:
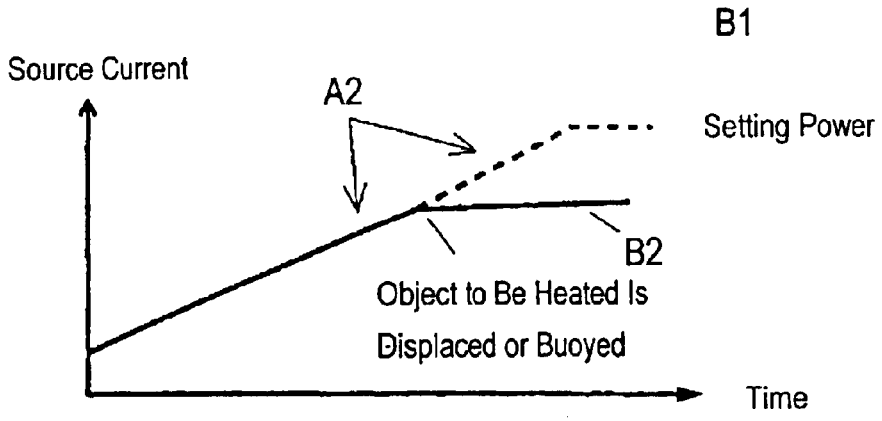
FIG. 4B illustrates a change against time of a source current supplied in the induction heating device of Embodiment 1.

At the startup, the controller 18 adjusts the driving frequency or the driving duty to increase the output of the high-frequency inverter from a low level to a predetermined level, as denoted by a real line A1 and a broken line A1 in FIG. 4A. The source current increases to a level corresponding to the setting level of the power, as denoted by a line A2 in FIG. 4B. The cooking pot 9, being made of highly conductive non-magnetic material, such as aluminum, may be displaced or buoyed by repulsive forces. The current applied to the induction heating coil 8 increases, and the current induced to the cooking pot 9 thus increases.

The displacement or the buoying of the cooking pot 9 occurs before the power increases from a lower level to the setting level at the startup. Then, an increasing rate of the input power declines as denoted by a curve B1 in FIG. 4A, and an increasing rate of the source current declines as denoted by a curve B2 in FIG. 4B.

The source-current-change detector 16 measures a changing rate of the source current based on the signal output from the source-current detector 15 and transfers the rate to the change examining unit 17. The change examining unit 17 judges that the cooking pot 9 is displaced by the repulsive forces if the rate of the change of the source current remains in a first range for a predetermined time. The judgement signal is transferred to the controller 18. Upon receiving the judgement signal, the controller 18 stops an operation of the inverter circuit 7 or controls the output of the inverter circuit 7 for inhibiting the displacement of the cooking pot 9.

Figure 5A:
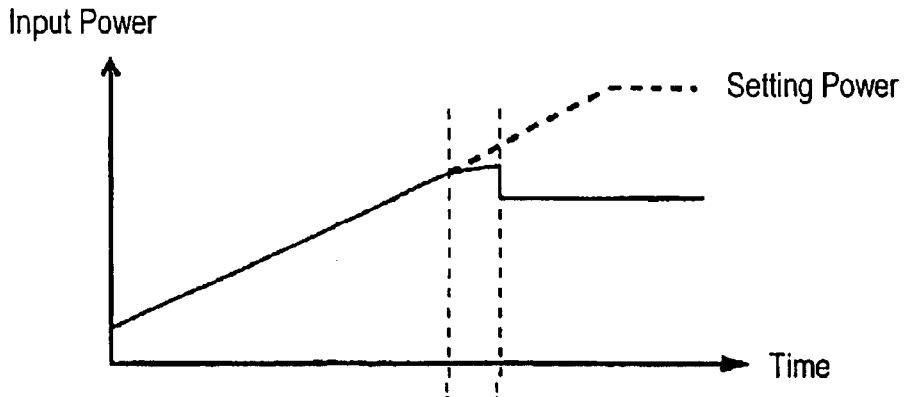
FIG. 5A illustrates a change against time of the input power controlled in response to a detection of a displacement or a buoying of an object to be heated by the induction heating of Embodiment 1.
Figure 5B:
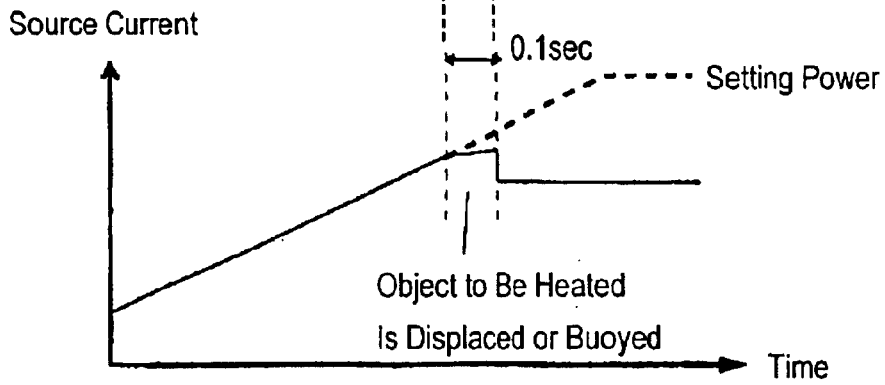
FIG. 5B illustrates a change against time of the source current controlled in response to a detection of the displacement or the buoying of the object to be heated by the induction heating of Embodiment 1.

FIG. 5 illustrates an operation of the controlling. FIG. 5, similarly to FIG. 4, shows a change against time of the input power and a change against time of the input current. As shown in FIG. 5, a change of an inclination of the input current caused by the displacement or buoying of the cooking pot 9 is detected at substantially 0.1 seconds after the occurrence of the change, and then, the input power is controlled to a level lower than the setting level.

If the inverter circuit 7 for the power controlling responds fast, the controller 18 can quickly response to a change of the magnetic coupling and adjust the driving condition to increase the input power. This quick response may accordingly interrupt the detection of the change of the source current caused by the displacement or buoying of the cooking pot 9. For correcting this, the controller 18 of this embodiment has an increasing rate of the input power per unit time determined to be near or less than such rate that the change of the source current can be detected.

According to an experiment, it was confirmed that a time required for detecting the displacement or buoying of a cooking pot was shorter than substantially 0.1 seconds. When the time required for detecting the displacement or buoying of a cooking pot is not longer than substantially 0.1 seconds, the displacement or buoying of the cooking pot is not visible, thus allowing a user to cook easily. According to experiments by an inventor, when the time required for detecting the displacement or buoying was 1 second, the displacement of the cooking pot 9 may be noted more. Therefore, the time required for detecting the displacement or buoying does not preferably exceed one second, and more preferably is not longer than 0.1 seconds. This condition prevents the displacement or the buoying from being noted.

As described above, the induction heating range of this embodiment includes the source-current detector 15 for detecting the source current supplied to the high-frequency inverter including the induction heating coil 8 and the inverter circuit 7, the source-current-change detector 16 for detecting the displacement or buoying of the cooking pot 9, and the change examining unit 17. In response to the output of the change examining unit 17, the controller 18 determines the output of the high-frequency inverter. This structure allows the induction heating range to have a small number of primary components, thus reducing cost. By examining that the output of the source-current detector 15 for determining the input power, the range allows the cooking pot 9 to be prevented from being displaced or buoyed even when the user does not touch the pot at the startup of heating.

According to this embodiment, the source current supplied to the high-frequency inverter is measured by the output detector for detecting a change against time of the output of the high-frequency inverter easily and is used for a displacement detector. The source-current detector is commonly used for setting the output of the high-frequency inverter and may be adapted to detect a change against time of the magnitude of the output of the high-frequency inverter. Therefore, the induction heating device of the embodiment can be inexpensive and have a small number of primary components.

The inverter circuit 7 according to the embodiment includes an inverter having two switching elements, however may include a voltage-resonant inverter having a single switching element in which the input current varies in proportion to a change of the magnetic coupling with a load (the object to be heated). Advantageously, the inverter 7 of the embodiment can heat the cooking pot 9 made of material having a high conductivity and a small magnetic permeability, such as aluminum. During heating the material, a resonant circuit composed of the induction heating coil 8, the resonant capacitor 7*g*, and the cooling pot 9 has a large Q-value (a sharp resonance) thus increasing a change of the output of the inverter 7 and the coil 8 according to a change of the magnetic coupling between the heating coil 8 and the cooking pot 9 under the same driving conditions. This allows the displacement or buoying of the pot 9 to be detected accurately (and responsively). (Those advantageous effects are provided in the following embodiments).

The output of the inverter is changed by, but not limited to, adjusting either the driving frequency of the inverter circuit 7 or the driving duty between the switching elements according to the embodiment. (This will stand in the following embodiments).

When some or all of the functions of the source-current-change detector 16, the change examining unit 17, and the controller 18 are implemented by a microcomputer, the induction heating device can has a small size, an improved handling, and be protected from the displacement of the pot. The circuitry arrangement or the program for providing the functions of the microcomputer is not limited to that of the embodiment. (This will stand in the following embodiments).

In the above description of the embodiment, the cooking pot, i.e., the object to be heated is displaced or buoyed at the startup of the heating. The detection action of the embodiment is applicable to another case that the object is displaced or buoyed during the heating (for example, while contents in a cooking pot is evaporated and having its weight being reduced). In the latter case, the detector detects that the input current is reduced from its constant level. (This will stand in the following embodiments).

According to Embodiment 1, the output detector measures the (peak or average) magnitude of the output of the high-frequency inverter, and thus detects a change of the magnetic coupling between the induction heating coil and the object in the induction heating device under the same driving conditions. In the case that the driving conditions of the switching elements for controlling the output of the high-frequency inverter remaining unchanged, when the magnetic coupling declines, the output of the high-frequency inverter decreases. When the magnetic coupling increases, the output increases.

According to the above, the displacement detector measures a change of the magnetic coupling between the induction heating coil and the cooking pot based on a change of the magnitude of the output of the high-frequency inverter detected by the output detector, hence detecting a change of the distance or the positional relationship between the induction heating coil and the cooking pot.

The displacement detector measures a change against time of the output of the high-frequency inverter as well as the magnitude of the output of the inverter. Thus, the detector can detects the displacement of the cooking pot caused by repulsive forces generated by respective currents flowing in the induction heating coil and the cooking pot based on a change of the output when the output is gradually increased from a low startup level to the setting level, i.e., during a soft start-up. Further, the detector detects the displacement of the cooking pot caused by the repulsive forces generated by a mutual action of the currents flowing in the induction heating coil and in the cooking pot based on a change of the magnetic coupling measured when the cooking pot is displaced or buoyed intentionally by the user.

The output of the high-frequency inverter is controlled in response to the result of measurement of the displacement detector. When the displacement or buoying of the object to be heated is detected, the output of the high-frequency inverter declines or stopped temporarily for continuously avoiding unsafe cooking operation, and, if desired, an alarm sound may be emitted. The output may also be adjusted for continuing a cooking operation.

According to the embodiment, the displacement detector detects the displacement or buoying of the object based on a change against time of the magnitude of the output of the high-frequency inverter before the output of the high-frequency inverter increases from a low, initial level to a stable setting level at the startup. This operation can protect the object from being buoyed before the output reaches the setting level from the start of the operation.

When the output of the high-frequency inverter reaches the setting level, the displacement detector of the embodiment detects the displacement or buoying of the object based on a change against time of the output of the high-frequency inverter. This operation can protect the object from being buoyed when the object has a weight decreasing according to evaporation or exhausting of water contained in the object or according to a removing of contents in the object during the heating operation of the induction heating device.

Exemplary Embodiment 2

Figure 6:
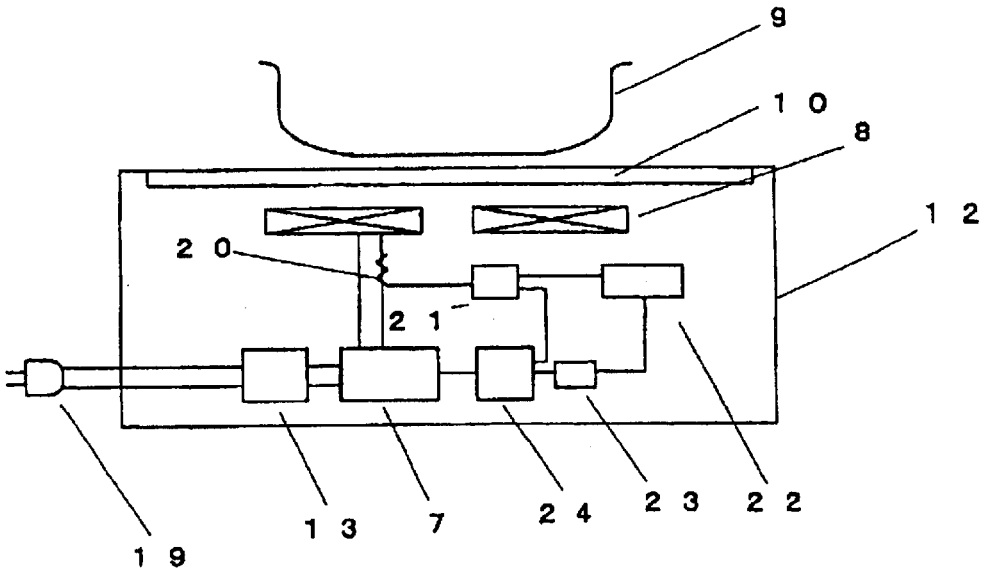
FIG. 6 is a schematic view of an induction heating device according to exemplary Embodiment 2 of the invention.
Figure 7:
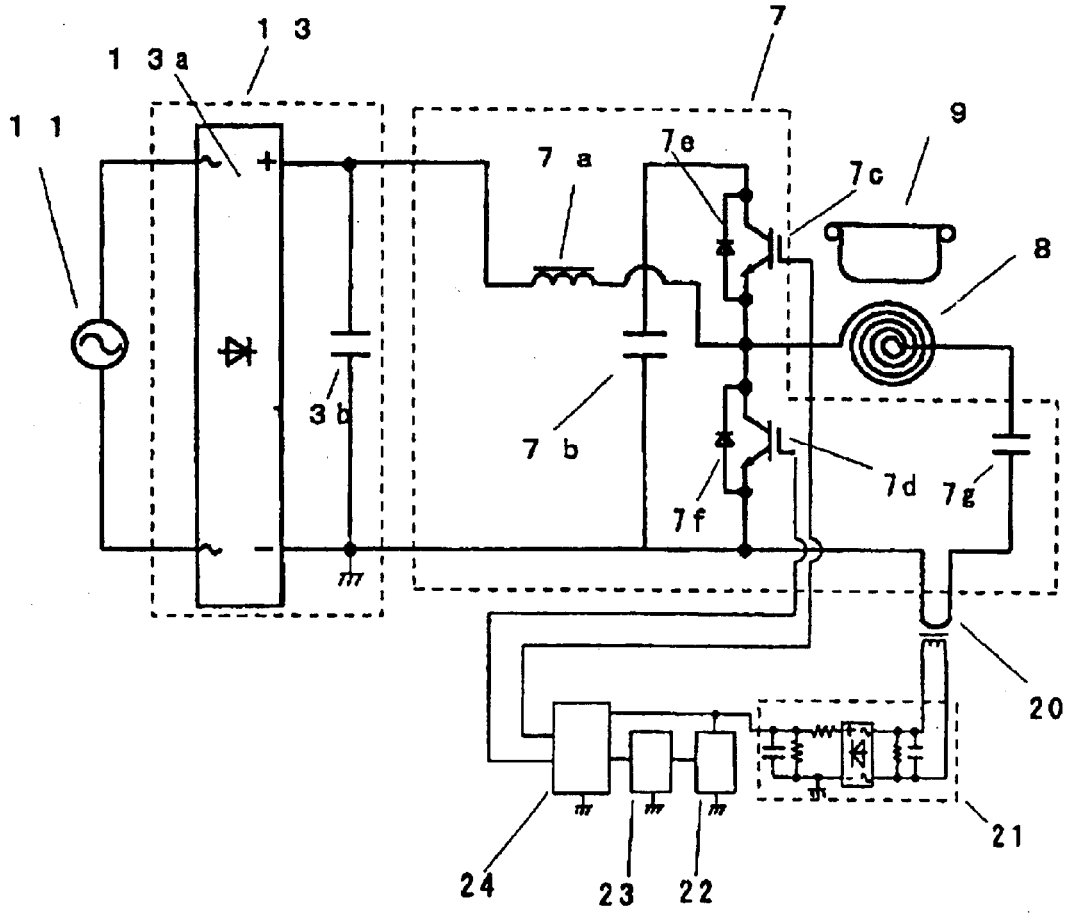
FIG. 7 is a circuit block diagram of the induction heating device of Embodiment 2.

FIG. 6 is a schematic cross sectional view of an induction heating range according to Exemplary Embodiment 2 of the present invention. FIG. 7 is a circuit block diagram of the range. An inverter circuit 7, an induction heating coil 8, a cooking pot 9 provided as a object to be heated, a top plate 10, a case 12, a rectifying/smoothing section 13, and a power source plug 19 shown in FIGS. 6 and 7 are identical to those of Embodiment 1 thus being denoted by like numerals in FIGS. 1 and 2, and will thus be explained in no more detail.

The following feature is differentiated from that of Embodiment 1. A current transformer 20 detects a current flowing in the induction heating coil 8. A coil-current detector 21 measures a magnitude of the current flowing in the induction heating coil 8. A coil-current-change detector 22 detects a change against time of the magnitude of the current flowing in the induction heating coil 8 (detects a change to lapse of time of a peak or an average of the current). A change examining unit examines the detection result of the coil-current-change detector 22 to determine whether or not the displacement or buoying of the cooking pot 9 is caused by repulsive forces between the induction heating coil 8 and the cooking pot 9. A controller 24 controls an output of the inverter circuit 7.

Upon receiving a signal output from the coil-current detector 21, the change examining unit 23 determines the displacement or buoying of the cooking pot 9 based on a change against time of the current flowing in the induction heating coil 8.

The signal output from the coil-current detector 21 is input to the controller 24, and the controller suppresses a power input to the inverter circuit 7 when switching elements 7*e* and 7*f* receive excessive load due to an increase of the current in the induction heating coil 8 for to the cooking pot 9 made of non-magnetic SUS material. As the magnetic coupling between the induction heating coil 8 and the cooking pot 9 declines, the current flowing in the induction heating coil 8 decreases while the inverter circuit 7 is driven at a constant frequency with a driving duty.

Figure 8A:
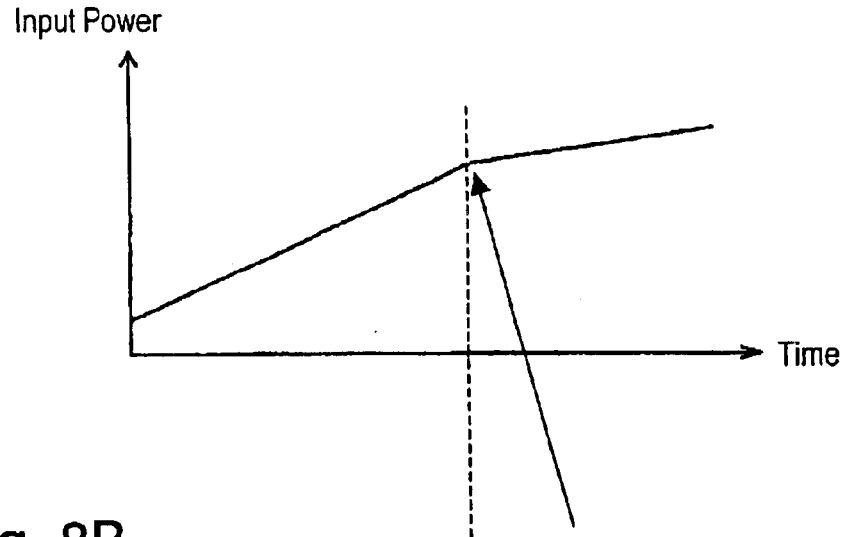
FIG. 8A illustrates a change against time of an input power controlled in response to an detection of the displacement or a buoying of an object to be heated by the induction heating of Embodiment 2.
Figure 8B:
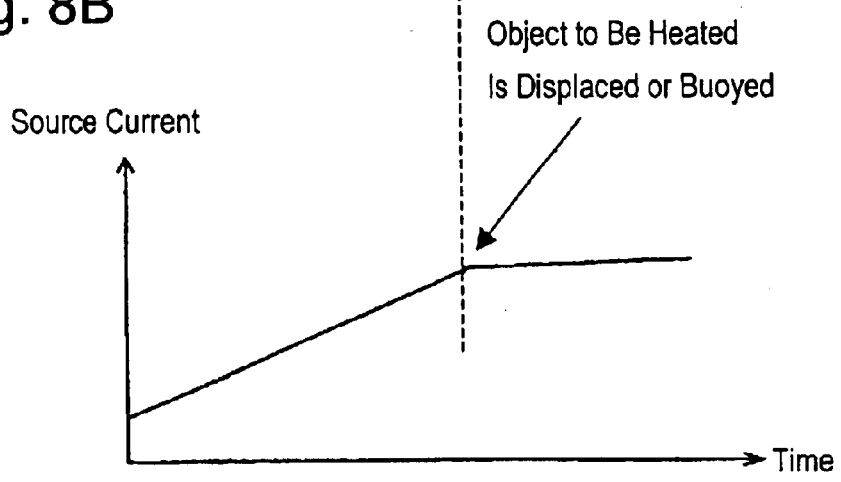
FIG. 8B illustrates a change against time of a current flowing in an induction heating coil controlled in response to a detection of the displacement or the buoying of the object to be heated by the induction heating device of Embodiment 1.

As shown in FIGS. 8A and 8B, a change (a decrease) of an inclination of the current in the induction heating coil 8 which results from a decrease of the magnetic coupling between the induction heating coil 8 and the cooking pot 9 caused by the displacement or buoying of the cooking pot 9 at the startup or during a soft period of the startup is detected. Then,.the heating is stopped or suppressed to reduce the input power for preventing the displacement and buoying of the cooking pot 9

According to this embodiment, a change of the current flowing in the induction heating coil 8 is detected. The detecting of the change of the current allows a change of an operation of the inverter to be detected faster than a detecting of a change of a current input to the inverter, hence allowing the displacement and the buoying of the cooking pot 9 to be detected faster.

The output detector measures the high frequency current which is generated by the high-frequency inverter and flows in the induction heating coil, the switching element, and the resonant capacitor, and can thus detect a change against time of the magnitude of the output of the high-frequency inverter. The output detector may function as a high-frequency current detector for detecting a change of the magnetic coupling at high sensitivity used in a protector circuit or an overload detector for eliminating over-voltages or over-currents.

Exemplary Embodiment 3

Figure 9:
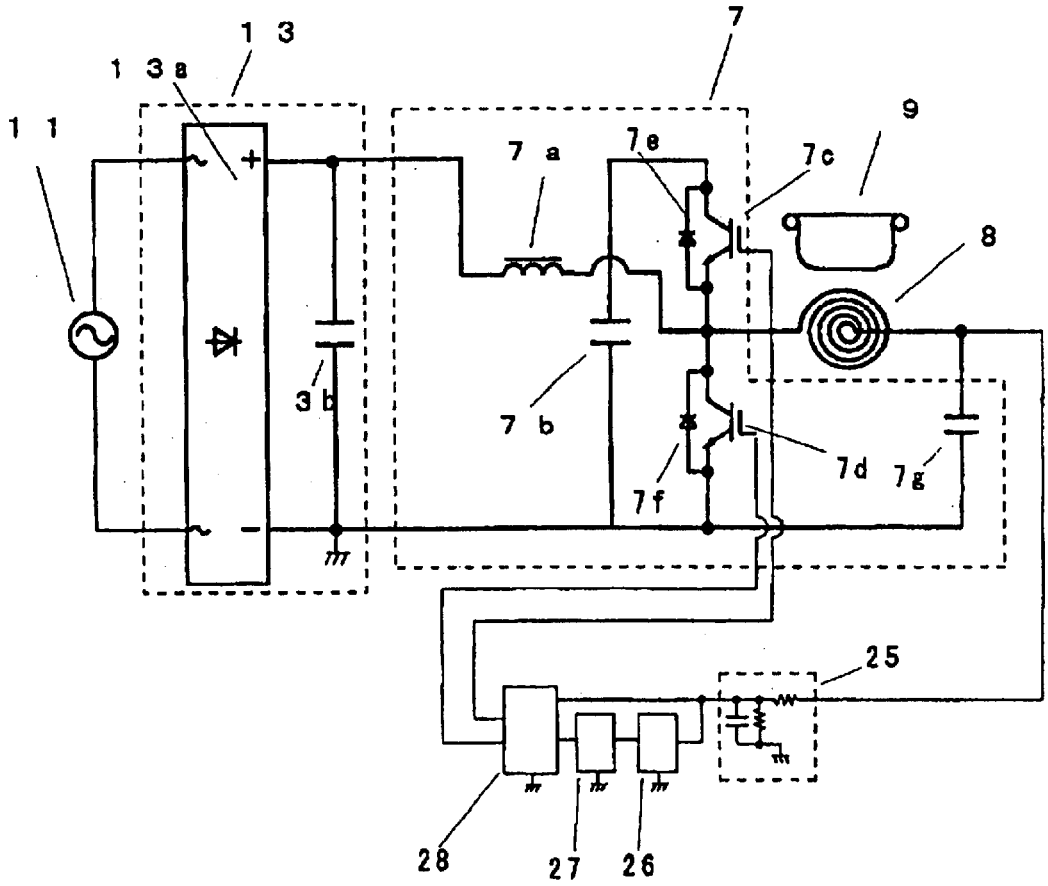
FIG. 9 is a circuit block diagram of an induction heating device according to Exemplary Embodiment 3 of the invention.
Figure 10:
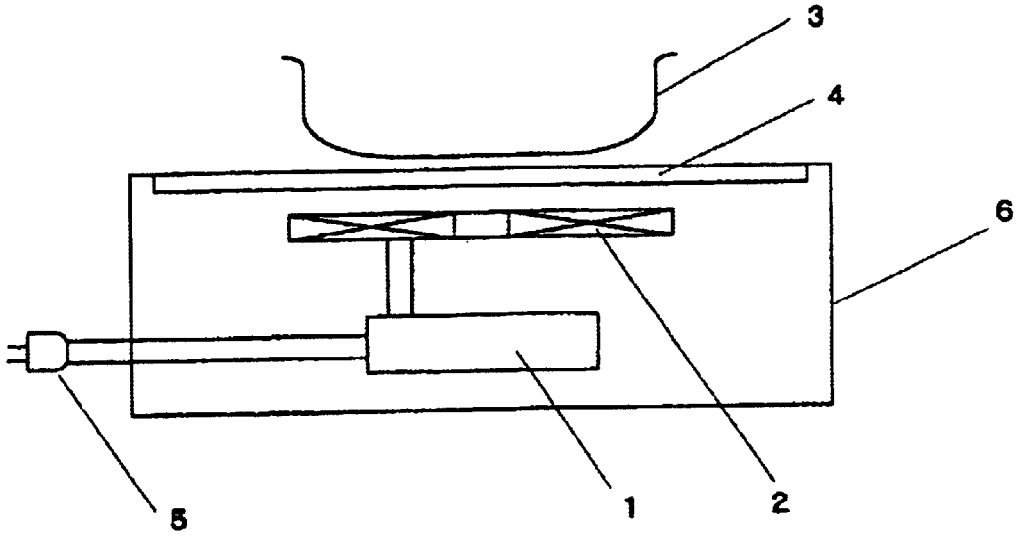
Fig. 10 PRIOR ART
FIG. 10 is a schematic view of a conventional induction heating range.
Figure 11:
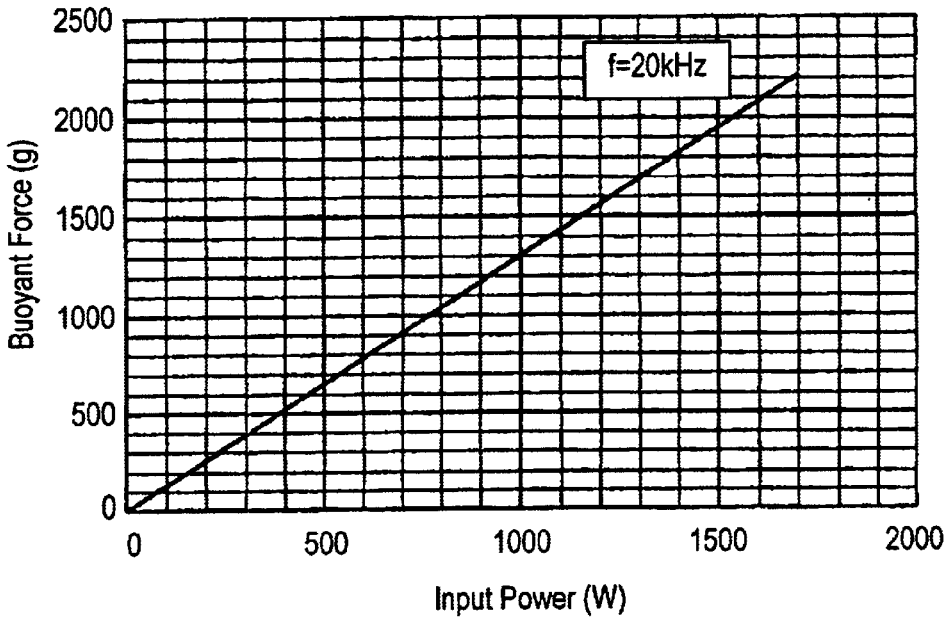
Fig. 11 PRIOR ART
FIG. 11 illustrates a profile of the relationship between an input power and a buoyant force of the conventional induction heating range.

FIG. 9 is a circuit block diagram of an induction heating range according to Exemplary Embodiment 3 of the present invention. In FIG. 9, like components are denoted by like numerals as those of Embodiment 2 shown in FIG. 7, and their functions will be explained in no more detail.

The range of this embodiment is different from that of Embodiment 2 in the following features. A high-frequency-voltage detector 25 measures a voltage of a resonant capacitor 7*g*, a component in an inverter circuit 7. A voltage-change detector 26 measures a change against time of the voltage based on a signal output from the high-frequency-voltage detector 25. A change examining unit 27 detects a displacement and a buoying of a cooking pot 9 based on a measurement result of the voltage-change-detector 26.

The other arrangement and operation is identical to that of Embodiment 2. Since the voltage of the resonant capacitor 7*g* is substantially proportional to the current flowing in the induction heating coil 8, the range of this embodiment has effects similar to those of Embodiment 2.

The voltage of the resonant capacitor 7*g* can be measured with a resistor division, thereby allowing the induction heating range of this embodiment to be inexpensive and to have a size smaller than that of Embodiment 2, which includes a current transformer for measuring the current. Moreover, the advantageous effects of this embodiment may be realized inexpensively with using of a voltage output from a voltage-protection device provided for voltage control.

According to this embodiment, the induction heating ranges are explained, and however their advantages and effects may equally be obtained by any induction heating device where the positional relationship between an induction heating coil and an object to be heated may change, such as a heating device for heating liquid in a metal pot or a metal heating device installed in a metallic enclosure for business use.

The output detector measures the high frequency voltage generated by the high-frequency inverter, e.g. a voltage of the induction coil, the resonant capacitor, or the switching element, and therefore can effectively measure a change against time of the magnitude of an output of the high-frequency inverter easily and efficiency. The voltage detector may be implemented less expensive in a smaller size than a current detector.

The output detector of the embodiments may be arranged to measure at least two of a change against time of a magnitude of the source current, a change against time of a magnitude of the high frequency current, and a change against time of the magnitude of the high frequency voltage from the high-frequency inverter which are then input to the displacement detector.

Industrial Applicability

An induction heating device according to the present invention prevents an object to be heated, such as a cooking pot, from being displaced and buoyed due to a magnetic field generated by an induction heating coil. The induction heating device is inexpensive since having a simple arrangement with some extra components. The induction heating device has a high operational reliability because of a small number of components included therein.

What is claimed is:

1. An induction heating device comprising:

an induction heating coil for generating a high frequency magnetic field to heat an object;

an inverter for supplying a high frequency current to the induction heating coil;

an output detector for detecting an magnitude of an output of the inverter by detecting a power or a source current input to the inverter;

a displacement detector for measuring a change against lapse of time of the magnitude of the output of the inverter detected by the output detector and for detecting a displacement of the object based on the measured change; and a controller for controlling the output of the inverter in response to a detection result of the displacement detector.

2. The induction heating device according to claim 1, wherein the displacement detector detects a displacement of the object based on the change against lapse of time of the magnitude of the output of the inverter before the output of the inverter shifts to a stable level from a level at a startup lower than the stable level.

3. The induction heating device according to claim 1, wherein the displacement detector detects a displacement of the object based on the change against lapse of time of the magnitude of the output of the inverter while the output is at a stable level.

4. An induction heating device comprising:

an induction heating coil for generating a high frequency magnetic field to heat an object;

an inverter for supplying a high frequency current to the induction heating coil;

an output detector for detecting a magnitude of an output of the inverter by detecting a peak or an average of a high frequency current or voltage produced by the inverter;

a displacement detector for measuring a change against lapse of time of the magnitude of the output of the inverter detected by the output detector and for detecting a displacement of the object based on the measured change; and a controller for controlling the output of the inverter in response to a detection result of the displacement detector.

5. The induction heating device according to claim 4, wherein the displacement detector detects a displacement of the object based on the change against lapse of time of the magnitude of the output of the inverter before the output of the inverter shifts to a stable level from a level at a startup lower than the stable level.

6. The induction heating device according to claim 4, wherein the displacement detector detects a displacement of the object based on the change against lapse of time of the magnitude of the output of the inverter while the output is at a stable level.

* * * * *